US005505433A

United States Patent [19]

Carmichael et al.

[11] Patent Number: 5,505,433

[45] Date of Patent: Apr. 9, 1996

[54] SHEET REMOVAL APPARATUS AND METHOD

[76] Inventors: Leo G. Carmichael, P.O. Box 1427, Conway, N.H. 03818; Christopher J. Carmichael, 130 Dayton St., Danvers, Mass. 01923

[21] Appl. No.: 346,828

[22] Filed: Nov. 30, 1994

Related U.S. Application Data

[63] Continuation of Ser. No. 962,242, Oct. 16, 1992, abandoned.

[51] Int. Cl.[6] ..... B25B 25/00

[52] U.S. Cl. ..... 254/211; 254/119; 156/584; 156/344

[58] Field of Search ..... 254/113, 119, 254/209, 211; 156/584, 344

[56] References Cited

U.S. PATENT DOCUMENTS

| | | | |
|---|---|---|---|
| 343,412 | 6/1886 | Willix | 254/211 |
| 456,001 | 7/1891 | Hinkle | 254/211 |
| 466,749 | 1/1892 | Case | 254/211 |
| 574,816 | 1/1897 | Newlon | 254/209 |
| 660,707 | 10/1900 | Lownes | 254/211 |
| 809,545 | 1/1906 | Wever | 254/209 |
| 860,992 | 7/1907 | Richardson | 254/209 |
| 965,118 | 7/1910 | McBeth | 254/209 |
| 1,971,218 | 8/1934 | Hoobler | 254/62 |
| 3,617,424 | 11/1971 | Smith | 156/344 X |
| 4,129,326 | 12/1978 | Weck | 294/8.6 |
| 4,332,371 | 6/1982 | Bell | 254/203 |
| 4,533,118 | 8/1985 | Thomas et al. | 156/584 X |
| 4,560,146 | 12/1985 | Thomas | 254/202 |
| 4,640,735 | 2/1987 | Murray et al. | 156/584 |
| 4,906,323 | 3/1990 | Thomas | 156/584 |
| 4,948,451 | 8/1990 | Foltz | 156/344 |
| 4,956,044 | 9/1990 | Watanabe et al. | 156/584 X |

*Primary Examiner*—Daniel P. Stodola
*Assistant Examiner*—Michael R. Mansen
*Attorney, Agent, or Firm*—Hamilton, Brook, Smith & Reynolds

[57] ABSTRACT

An apparatus for removing a sheet of material anchored to the floor, such as a carpet, includes an anchor member capable of being releasably anchored to the sheet of material at one location. The anchor member has a foot strap. A handle is pivotally coupled to the anchor member. A rigid connecting member pivotably coupled to the handle by a connecting joint couples a gripper to the handle. The gripper grips the sheet of material at another location. The handle is capable of pivoting about the anchor member in order to pull the sheet of material gripped by the gripper upwardly from the floor.

17 Claims, 7 Drawing Sheets

SHEET REMOVAL APPARATUS AND METHOD

This application is a continuation of application Ser. No. 07/962,242 filed on Oct. 16, 1992, now abandoned.

FIELD OF THE INVENTION

This invention relates to apparatus for applying a pulling force on an anchored object such as a resilient floor covering or a tree stump.

BACKGROUND OF THE INVENTION

Removal of a carpet, especially if it has been anchored not only by weight and tacks but secured with adhesive is messy, uncomfortable and requires considerable strength. The carpet is grabbed and then pulled up and back.

U.S. Pat. No. 4,129,326 discloses a carpet lifter to aid in grasping a carpet having loop type pile. Such a device is good only with loop pile carpets, and does not change the amount of force which must be applied.

U.S. Pat. No. 4,332,371 uses a set of pulleys which are anchored to the floor surface with which to increase the effective force of the pulling action.

U.S. Pat. No. 4,560,146, incorporated herein by reference, details many of the difficulties with modern carpet application and removal that have required new methods and apparatus for removal. The patent discloses a gripping jaw assembly which is secured by cables through a series of secured pulleys to a preferably motorized winch.

U.S. Pat. No. 4,906,323, incorporated herein by reference, recognizes the need for a pulling device which can be used in smaller areas and which can be used without heavy mechanical equipment. It discloses a gripping jaw assembly secured by cable to a harness worn about the waist of the puller.

The above patents fail, however, to disclose a puller which is relatively compact, uses leverage to increase the effective force of the effort, and which is adjustable.

SUMMARY OF THE INVENTION

The apparatus of the present invention has a handle which extends pivotally from a foot plate. An extended carpet gripping assembly is pivotally connected in an adjustable manner to the handle. To use the assembly, the operator grasps the carpet in the assembly, holds the handle in the hands, steps on the foot plate and leans the handle back, pulling the grasping assembly toward the foot plate. At the end of the pull, the operator steps the foot plate back and again leans the handle back. By adjusting the height of attachment of the gripping assembly, the force and distance ratios of the pulling action can be tailored to the carpet and the operator.

DESCRIPTION OF THE PREFERRED EMBODIMENTS

Figure 1:
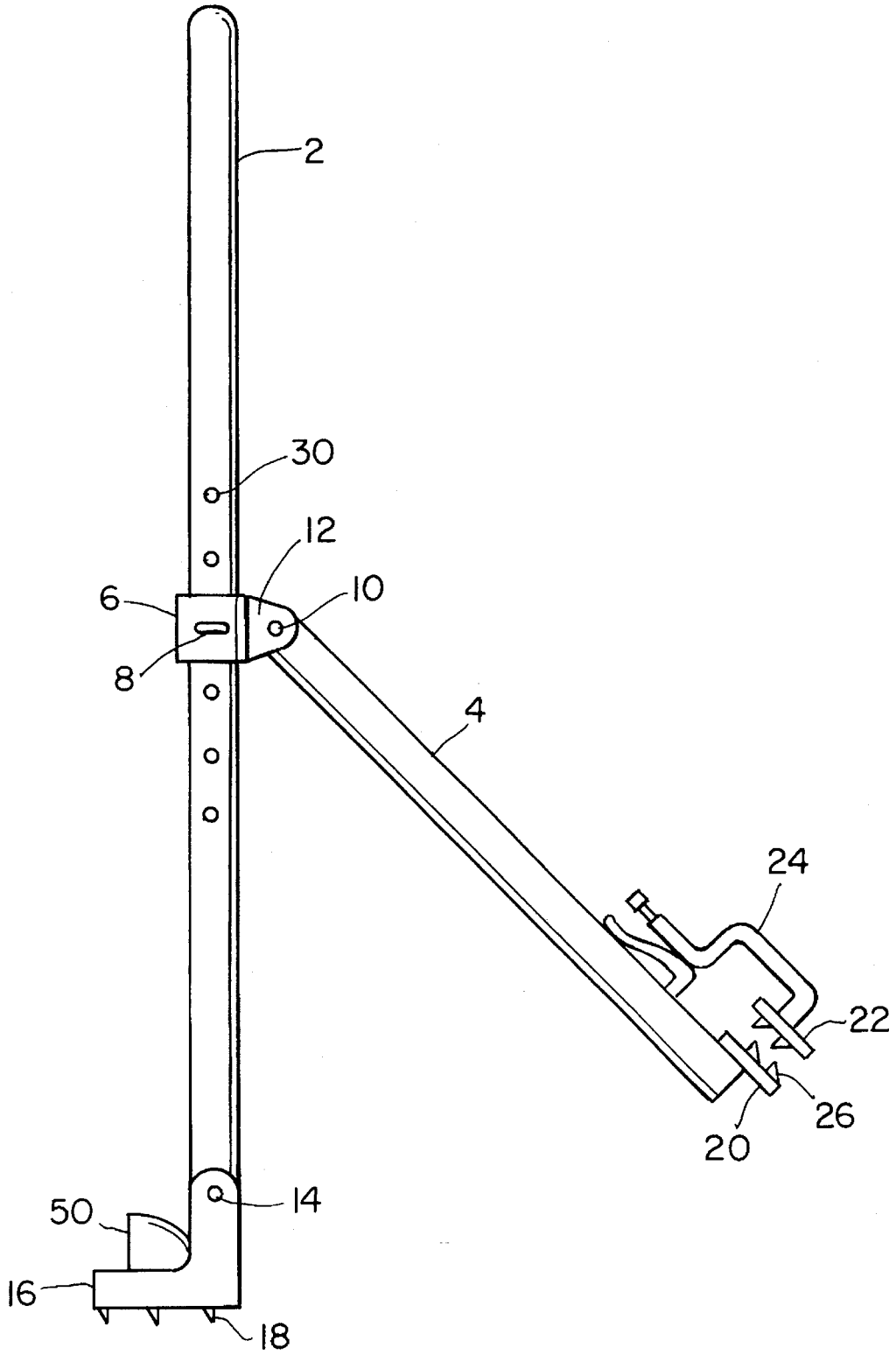
FIG. 1 is a side view of a carpet removal apparatus.
Figure 2:
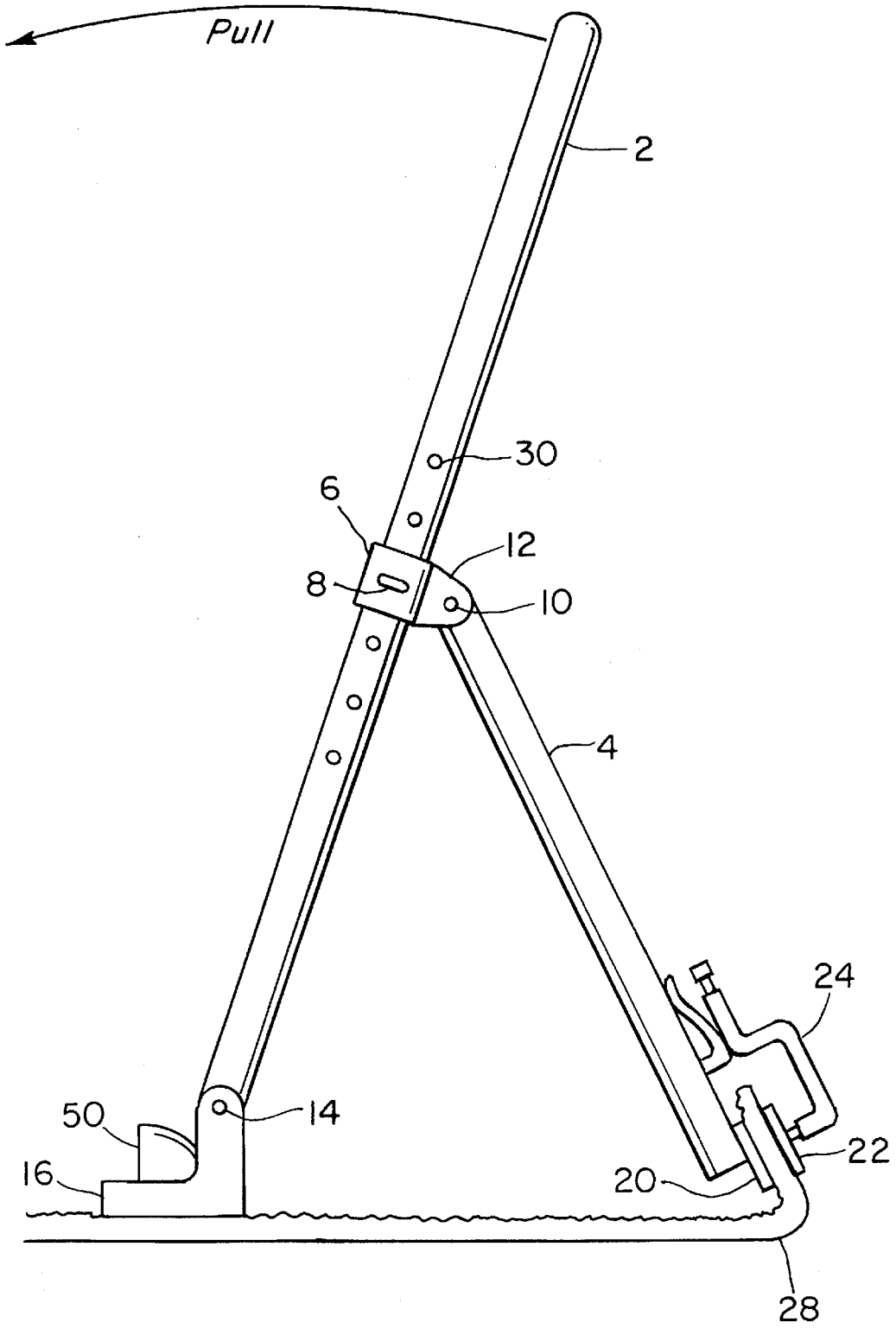
FIG. 2 is a side view of the carpet removal apparatus grasping a carpet.
Figure 3:
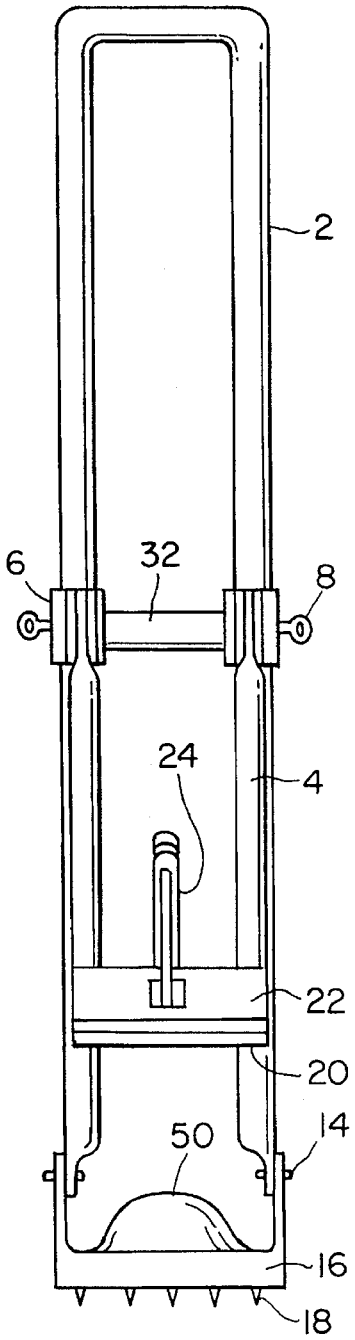
FIG. 3 is a front view of the carpet removal apparatus.
Figure 7A:
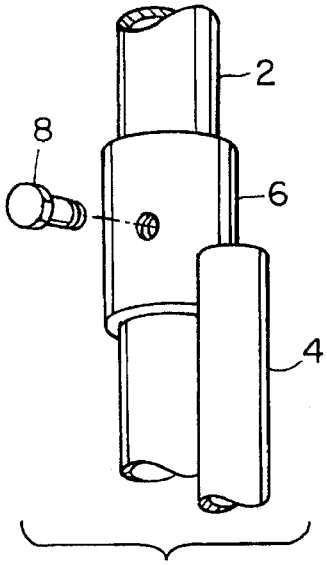
FIGS. 7A to 7C are details of a carpet pulling apparatus with adjustment means of set bolts, pins, and ratchets, respectively.
Figure 7B:
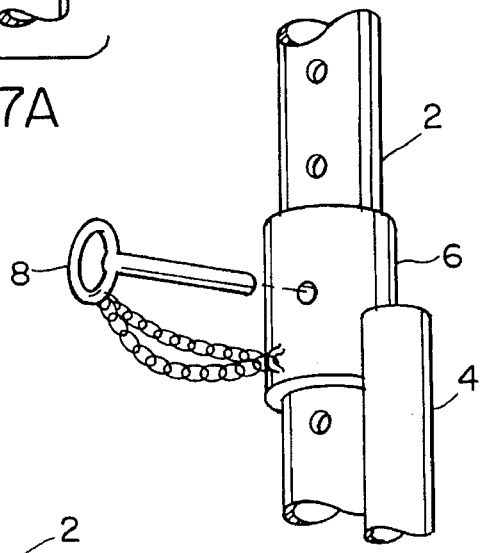
Figure 7C:
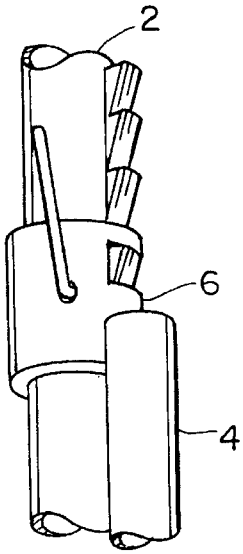

The carpet removal apparatus has a handle 2 shaped like an inverted U. At the base of handle 2 is a foot plate 16 which is mounted pivotally by pins 14. Teeth 18 rest on the carpet 28 providing an anchor. A quick release pin 8 can be placed quickly into a chosen aperture 30 in the handle 2 to adjust the height of the cylindrical section 6. A grip connecting arm 4 is pivotally attached at one end by a pivot pin 10 to section plate 12 which extends from the cylindrical section 6. Cylindrical sections 6 slide over the handle 2 and have a cross piece 32 connecting them. At the opposite end of the grip connecting arms 4 lower gripping plate 20 is located. The lower gripping plate 20 is connected to and biased toward the opposing upper gripping plate 22 by a pair of locking C-clamps such as available under the trademark VISE-GRIP 24. Angled teeth 26 provide a firm hold on the carpet 28. To use the tool, the operator steps on the foot plate 16 and moves the handle 2 back as shown, rotating the top of the handle about its base.

The rigid handle 2 could have other configurations than u shape, such as a T. It can be formed from any strong, rigid material. For lightweight strength, heavy aluminum piping having a diameter of between 6 and 8 cm has been found satisfactory.

A spiked foot plate 16 can be made of one or two plates and can be fitted with a strap or a foot shield 50. The pivotal connection can be made with pivot pins or bolts. A spring inserted between the handle 2 and the plate 16 could hold the plate at an angle to gaurd against accidental injury of a foot mistakingly placed under the plate 16. It is thought that the apparatus could be made without the foot plate, for example, with spiked handle base, however, the foot plate 16 offers a safe, strong means of anchoring.

While other adjustable systems such as tension bolts or ratchets may be used, a quick release pin 8 causes less damage to the handle. For ease of manufacture a fixed pivot could be formed on the handle also. To keep the pin 8 from becoming lost, a lanyard can be attached to the pin 8 at one end and to the cylindrical section 6 at the other end.

Figure 4:
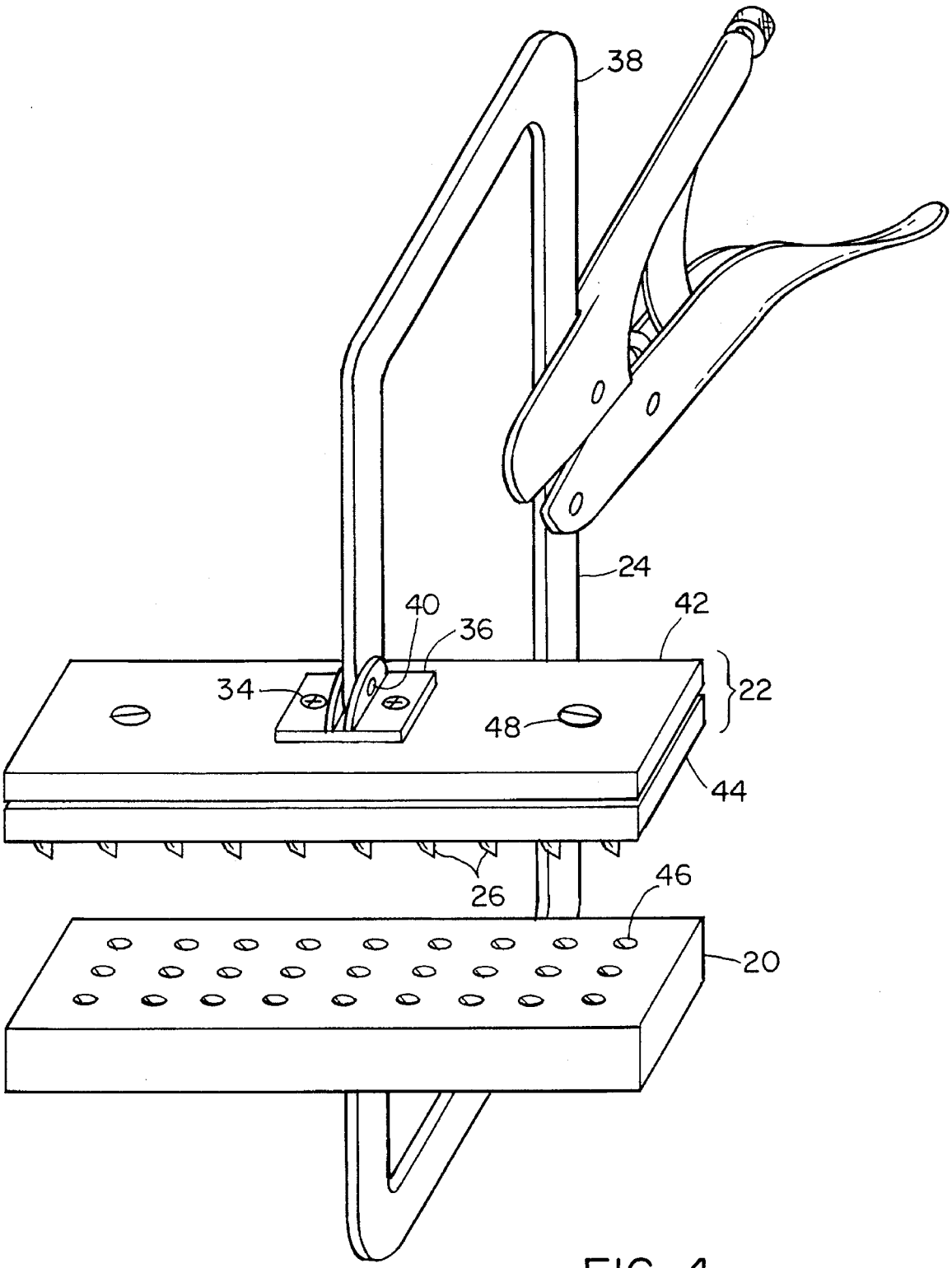
FIG. 4 is a perspective view of a carpet gripping assembly.
Figure 5:
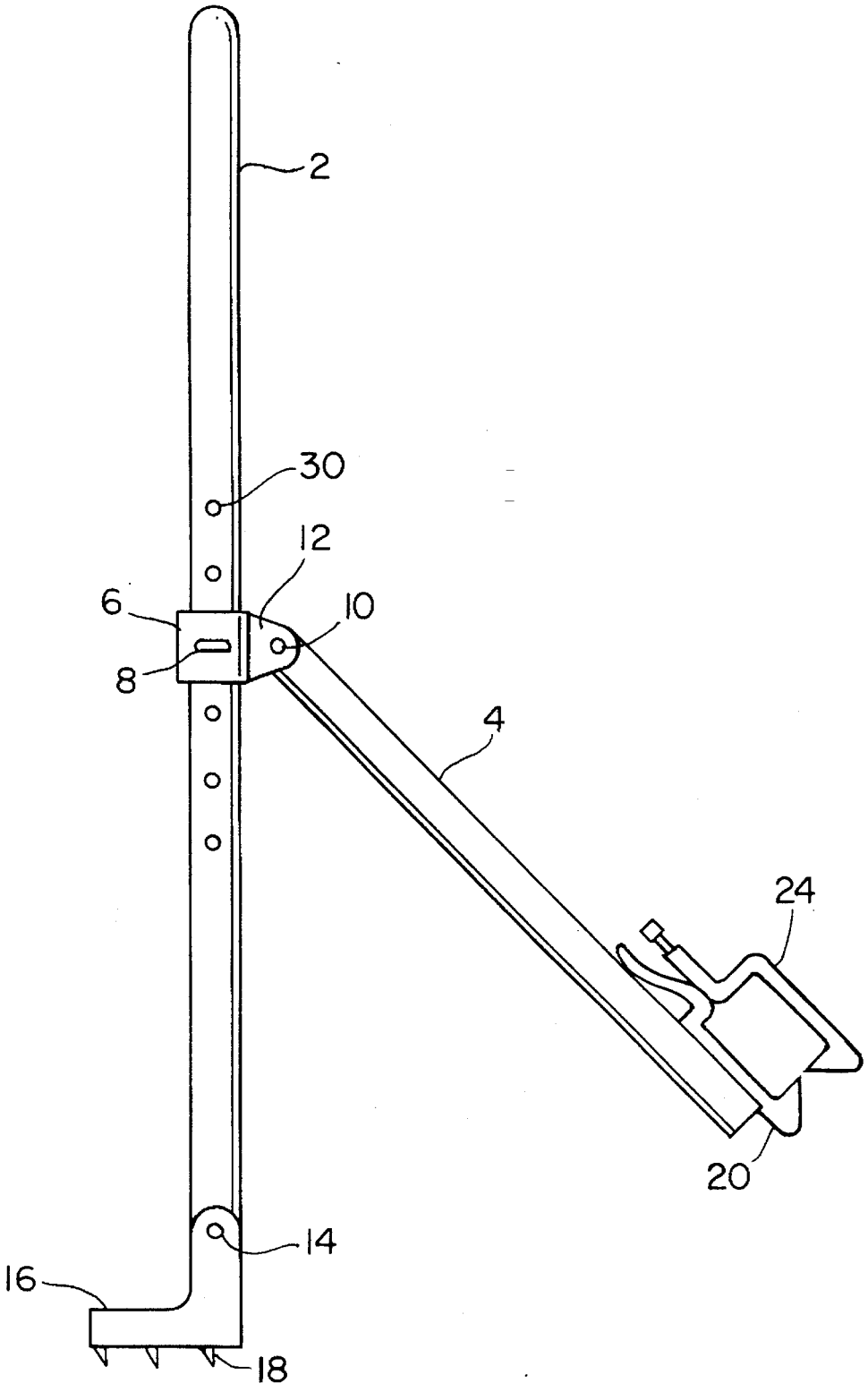
FIG. 5 is a perspective view of a carpet gripping assembly having hooks.
Figure 6A:
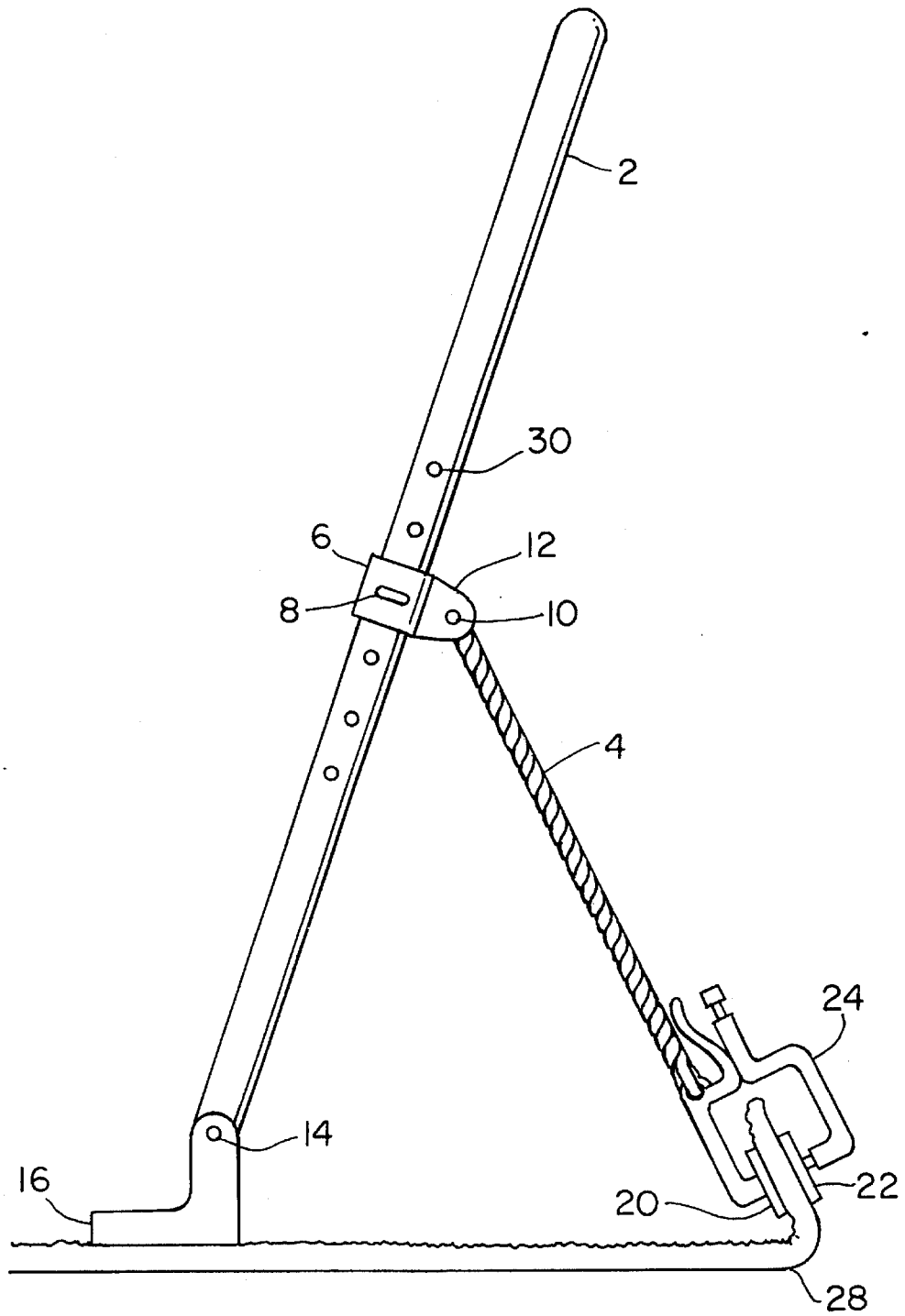
FIGS. 6A and 6B are details of a carpet pulling assembly connected by cable and chain respectively.
Figure 6B:
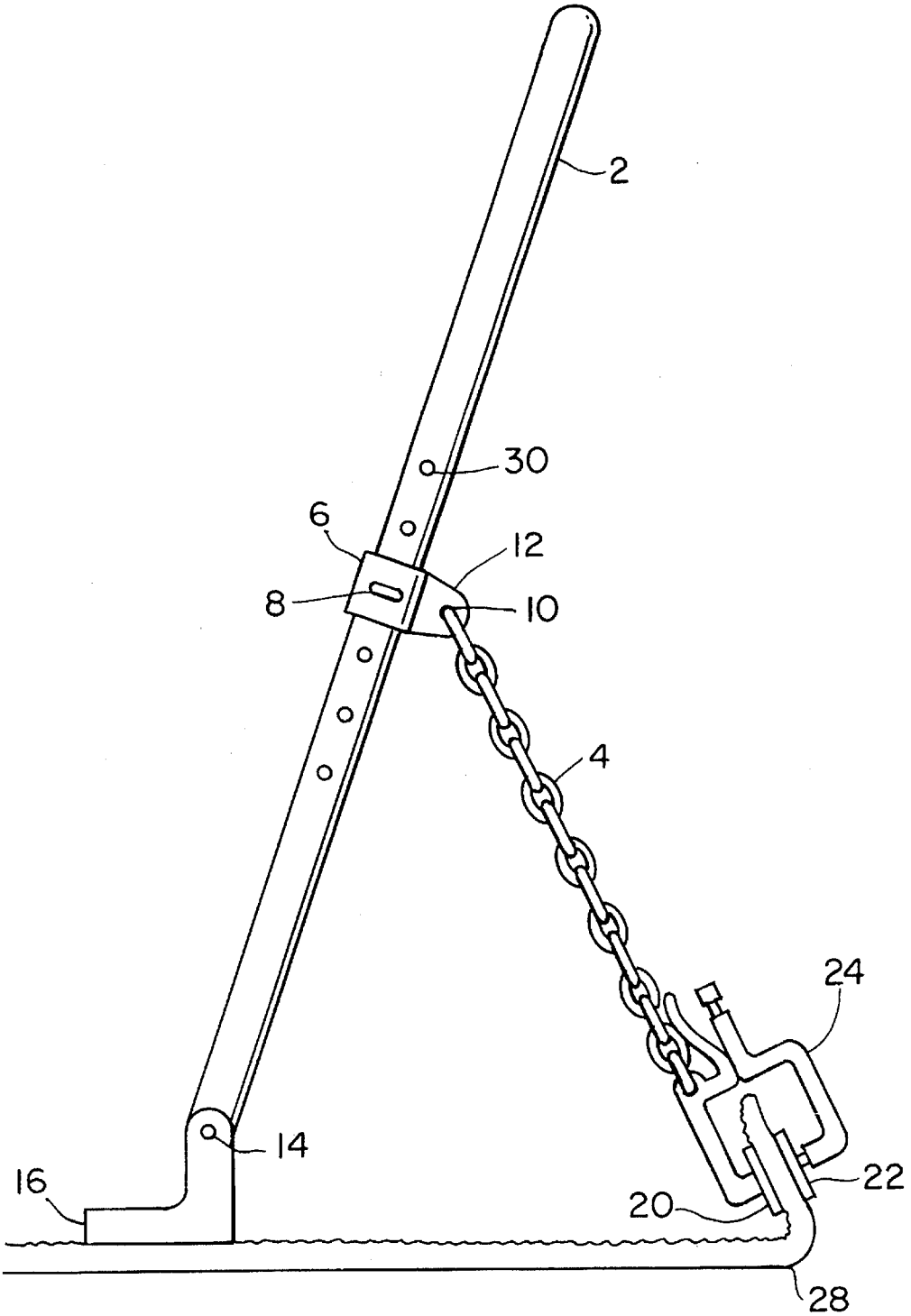

The object gripping means shown is for a carpet 28, however, other means, such as a hook, could be used to grip other objects such as small stumps. While opposing plates 20 and 22 connected by locking C-clamps 24 are preferred, other gripping assemblies described in the art could be attached at the end of the grip assembly arm 4. In place of spikes 26, other grasping means such as teeth or hooks could be used. FIG. 4 shows a preferred holder. Locking C-clamp 24 has pads 36 attached to C-arms 38 by a pivots 40. Threaded fasteners 34 allow for replacement of opposing plates 20 and 22. Upper plate 22 is made of two sub plates 42 and 44. Headed spikes 26 pass through lower sub plate 44 at an angle, and are held securly by upper sub plate 42. Fasteners 48 secure upper sub plate 42 to lower sub plate 44. Lower plate 20 is provided with angled apertures 46 for receiving spikes 26.

While the connecting means shown is an arm 4, other connecting means such as chains or cables may be used.

This carpet removal assembly provides a relatively portable, adjustable means of removing a carpet from a floor.

What is claimed is:

1. An apparatus for removing a sheet of material from a surface comprising:

an anchor member capable of being releasably anchored to the sheet of material at a first location, the anchor member including a foot receiving member;

a handle pivotably coupled to the anchor member;

a gripper for gripping the sheet of material at a second location; and a rigid connecting member for coupling the gripper to the handle, the connecting member being pivotably coupled to the handle by a connecting joint, the handle being capable of pivoting about the anchor member away from the gripper to move the gripper towards the anchor member such that the sheet of material gripped by the gripper is pulled from the surface upwardly and back toward the anchor member.

2. The apparatus of claim 1 in which the position of the connecting joint is adjustable relative to the handle for adjusting pulling force.

3. The apparatus of claim 1 in which the gripper comprises a pair of locking jaws.

4. An apparatus for removing a sheet of material from a surface comprising:

an anchor member capable of being releasably anchored to the sheet of material at a first location, the anchor member including a foot receiving member, the foot receiving member comprising a foot strap;

a handle pivotably coupled to the anchor member;

a gripper for gripping the sheet of material at a second location; and a rigid connecting member for coupling the gripper to the handle, the connecting member being pivotably coupled to the handle by a connecting joint, the handle being capable of pivoting about the anchor member away from the gripper to move the gripper towards the anchor member such that the sheet of material gripped by the gripper is pulled from the surface upwardly and back toward the anchor member.

5. A method for removing a sheet of material from a surface comprising the steps of:

anchoring an anchor member to the sheet of material at a first location;

gripping the sheet of material at a second location with a gripper; and pulling the sheet of material from the surface upwardly and back toward the anchor member by pivoting a handle connected to the anchor member and the gripper about the anchor member in a direction away from the gripper to move the gripper towards the anchor member.

6. The method of claim 5 further comprising the steps of:

un-anchoring the anchor member from the sheet of material;

re-anchoring the anchor member to the sheet of material at a new position away from the gripping member; and re-pivoting the handle about the anchor member away from the gripper to further pull the sheet of material from the surface.

7. The method of claim 6 in which the step of reanchoring the anchor member comprises stepping the anchor member backwardly.

8. The method of claim 5 further comprising the step of coupling the gripper to the handle with a rigid connecting member.

9. The method of claim 8 further comprising the step of pivotably coupling the connecting member to the handle with a connecting joint.

10. The method of claim 9 further comprising the step of adjusting the position of the connecting joint relative to the handle for adjusting pulling force.

11. The method of claim 5 further comprising the step of anchoring the anchor member under the weight of a person's foot.

12. A method for removing a sheet of material from a surface comprising the steps of:

anchoring an anchor member to the sheet of material at a first location;

gripping the sheet of material at a second location with a gripper;

pulling the sheet of material from the surface upwardly and back toward the anchor member by pivoting a handle connected to the anchor member and the gripper about the anchor member in a direction away from the gripper to move the gripper towards the anchor member;

un-anchoring the anchor member from the sheet of material;

re-anchoring the anchor member to the sheet of material at a new position away from the gripping member; and re-pivoting the handle about the anchor member away from the gripper to further pull the sheet of material from the surface upwardly and back toward the anchor member.

13. The method of claim 12 in which the step of reanchoring the anchor member comprises stepping the anchor member backwardly.

14. The method of claim 12 further comprising the step of coupling the gripper to the handle with a rigid connecting member.

15. The method of claim 1 further comprising the step of pivotably coupling the connecting member to the handle with a connecting joint.

16. The method of claim 1 further comprising the step of adjusting the position of the connecting joint relative to the handle for adjusting pulling force.

17. The method of claim 12 further comprising the step of anchoring the anchor member under the weight of a person's foot.

* * * * *

UNITED STATES PATENT AND TRADEMARK OFFICE

CERTIFICATE OF CORRECTION

PATENT NO. : 5,505,433

DATED : April 9, 1996

INVENTOR(S) : Leo G. Carmichael and Christopher J. Carmichael

It is certified that error appears in the above-indentified patent and that said Letters Patent is hereby corrected as shown below:

Col. 4, line 48, delete "1" and insert ---14---.

Col. 4, line 51, delete "1" and insert ---15---.

Signed and Sealed this

Sixteenth Day of July, 1996

*Attest:*

*Attesting Officer*

BRUCE LEHMAN

*Commissioner of Patents and Trademarks*